US009178308B1

(12) United States Patent
Kim et al.

(10) Patent No.: US 9,178,308 B1
(45) Date of Patent: Nov. 3, 2015

(54) SHIELD CONNECTOR FOR VEHICLE

(71) Applicants: Hyundai Motor Company, Seoul (KR); Korea Electric Terminal Co., Ltd., Incheon (KR)

(72) Inventors: Il Kim, Gyeonggi-do (KR); Hee Rock Choe, Incheon (KR)

(73) Assignees: Hyundai Motor Company, Seoul (KR); Korea Electric Terminal Co., Ltd., Incheon (KR)

( * ) Notice: Subject to any disclaimer, the term of this patent is extended or adjusted under 35 U.S.C. 154(b) by 0 days.

(21) Appl. No.: 14/526,292

(22) Filed: Oct. 28, 2014

(30) Foreign Application Priority Data

May 26, 2014 (KR) ..... 10-2014-0063234

(51) Int. Cl.

| | |
|---|---|
| ***H01R 12/00*** | (2006.01) |
| ***H01R 13/629*** | (2006.01) |
| ***H01R 13/648*** | (2006.01) |
| ***H01R 24/66*** | (2011.01) |
| ***H01R 24/76*** | (2011.01) |

(52) U.S. Cl.
CPC ..... *H01R 13/62977* (2013.01); *H01R 13/6485* (2013.01); *H01R 24/66* (2013.01); *H01R 24/76* (2013.01)

(58) Field of Classification Search
CPC ..... H01R 9/092; H01R 23/7063
USPC ..... 439/82, 567, 553, 862, 857, 660
See application file for complete search history.

(56) References Cited

U.S. PATENT DOCUMENTS

| | | | | |
|---|---|---|---|---|
| 5,417,593 | A * | 5/1995 | Suzuki et al. | 439/651 |
| 5,584,718 | A * | 12/1996 | Sukegawa | 439/352 |
| 7,704,098 | B2 * | 4/2010 | Lambie et al. | 439/607.28 |
| 7,771,235 | B2 * | 8/2010 | Kameyama | 439/607.27 |
| 2013/0178100 | A1 * | 7/2013 | Nagata et al. | 439/607.35 |

FOREIGN PATENT DOCUMENTS

| | | | |
|---|---|---|---|
| JP | 06-325827 | | 11/1994 |
| JP | 10-083865 | | 3/1998 |
| JP | 2001-015214 | | 1/2001 |
| JP | 2004-200454 | | 7/2004 |
| JP | 2004-296418 | A | 10/2004 |
| JP | 2005-203217 | | 7/2005 |
| JP | 2006-202573 | A | 8/2006 |
| JP | 2013-120738 | | 6/2013 |
| KR | 10-2009-0072232 | A | 7/2009 |

(Continued)

*Primary Examiner* — Phuongchi T Nguyen
(74) *Attorney, Agent, or Firm* — Mintz Levin Cohn Ferris Glovsky and Popeo, P.C.; Peter F. Corless

(57) ABSTRACT

A shield connector includes: a female connector having a female terminal connected to a shield wire and a locking protrusion; a male connector having a male terminal connected to the female terminal when the male connector is combined with the female connector, and a coupling protrusion to which the locking protrusion is locked for locking with the female connector; and a connector position assurance that is combined with the female connector to be movable forward/backward and has support levers that support the locking protrusion and prevent the locking protrusion from being unlocked from the coupling protrusion when the connector position assurance is moved forward, in which locking steps are formed at the female connector, and an insertion portion is formed at the male connector.

6 Claims, 10 Drawing Sheets

(56) References Cited * cited by examiner

FOREIGN PATENT DOCUMENTS

| | | |
|---|---|---|
| KR | 20-0465368 Y1 | 2/2013 |
| WO | 2009/047744 | 4/2009 |

SHIELD CONNECTOR FOR VEHICLE

CROSS-REFERENCE TO RELATED APPLICATION

This application claims under 35 U.S.C. §119(a) the benefit of Korean Patent Application No. 10-2014-0063234 filed on May 26, 2014, the entire contents of which are incorporated herein by reference.

BACKGROUND (a) Technical Field

The present invention relates to a shield connector, more particularly to a shield connector that can improve operability of a connector position assurance when it is combined, and ensure contact point stability and reliability between shield conductive parts, and thus allows for simplification of shield parts and improvement of convenience in assembly.

(b) Description of the Related Art

In general, a connector is a connection part used for electrically connecting a circuit with another circuit, and various connectors are used in vehicles in order to connect cables or wires.

Recently, the number of electric devices mounted on vehicles has increased for the convenience of users, and the number of necessary cables or wires has increased accordingly, so that many connectors for connecting them are used.

Connectors are generally composed of female and male connectors that can be fitted to each other. Also, a space where a terminal can be received is defined in the housing of each connector, and a plurality of terminals are usually received in one connector.

The terminal of the male connector can be inserted in the terminal of the female connector, and when the connectors are combined, they are electrically connected by the insertion of the terminal of the male connector in the terminal of the female connector.

Since the connectors are parts for electric connection, complete electrical and mechanical connection is necessary when they are combined.

Accordingly, various members are used for complete connection of the connectors, and more complete connection of connectors is required, when whether connection of connectors is ensured has an important influence on vehicle safety, such as in a wiring system for a vehicle.

To this end, as a technology for preventing a risk of disconnection of a connector due to a wire harness, a connector position assurance (CPA) is applied.

The connector position assurance is provided for preventing unlocking between connectors, that is, preventing a locking lever from being unlocked from a connector, where the locking lever is a part that prevents connectors at both sides from separating from each other.

The locking lever is formed at one of the connectors (at the housing of the connector) so that the locking lever is locked to a coupling portion of the other connector, when both connectors are combined.

The connector position assurance supports the locking lever to prevent separation of the connectors from being unlocked, and the locking lever can be unlocked only after the connector position assurance is unlocked.

According to the connector position assurance, it is possible to achieve complete combination of connectors and prevent separation of connectors due to unlocking of a locking lever.

A connector with a connector position assurance has been disclosed in Korean Patent Registration No. 10-0818629 (Mar. 26, 2008), and the connector position assurance of general connectors is formed as a separate part and coupled to a connector housing.

In particular, a connector position assurance is coupled to the housing of a connector (female connector as provided therein), and accordingly, by pushing the connector position assurance under a locking lever locked to the coupling portion of the other connector after the connectors are combined, the locking lever is deformed by an external force and the connector position assurance supports the locking lever to prevent separation of the connectors, thereby preventing sagging and unlocking of the locking lever.

However, the connector position assurance can move forward/backward in the housing of a connector, before both connectors are combined, so that the user has to pull backward the connector position assurance before combining the connectors and then push back the connector position assurance after combining the connectors.

If the connector position assurance has been pushed forward to the lock position before it is coupled to the other connector, the connection position assurance moved forward may be locked to the corresponding connector, so it is difficult to pull out the connector position assurance.

Further, in order to combine both connectors with the connector position assurance pushed forward, not pulled back, the locking lever is already at the lock position by the connector position assurance, so it may be difficult to combine the other connector.

Accordingly, there is a need of a structure that allows for reduced complexity of operation and simple combination when connectors are combined.

On the other hand, shield wires and shield connectors are used to reduce noise in electric signals. In particular, a shield and ground path are formed from a wire shield to the grounding terminal of a car body or electric devices by the internal parts of connectors, when the connectors are combined.

However, there are many complicated conductive parts for forming electric shield and grounding paths, it is difficult to ensure price competitiveness, and contact point stability and reliability between conductive parts, and bolting is required to form and maintain contact points between separate conductive parts, so assembly is not convenient.

The above information disclosed in this Background section is only for enhancement of understanding of the background of the invention and therefore it may contain information that does not form the prior art that is already known in this country to a person of ordinary skill in the art.

SUMMARY

The present invention provides a shield connector that can improve operability of a connector position assurance when the connector is combined, and ensure contact point stability and reliability between shield conductive parts, and thus allows for simplification of shield parts and improvement of convenience in assembly.

In one aspect, the present invention provides a shield connector including: a female connector having a female terminal connected to a shield wire and a locking protrusion for locking to a male connector; the male connector having a male terminal connected to the female terminal when the male connector is combined with the female connector, and a coupling protrusion to which the locking protrusion is locked for locking with the female connector; and a connector position assurance that is combined with the female connector to be movable forward/backward and has support levers that support the locking protrusion and prevent the locking protrusion from being unlocked from the coupling protrusion when the connector position assurance is moved forward, in which locking steps, to which the support levers are locked so that the connector position assurance cannot be moved before the female connector and the male connector are combined, are formed at the female connector, and an insertion portion, which unlocks the support levers from the locking steps by pressing pressing protrusions on the support levers when the female connector and the male connector are combined, is formed at the male connector.

The insertion portion has a space, where the locking lever of the female connector and the support levers of the connector position assurance are inserted, when the male connector and the female connector are combined, and presses the pressing protrusions of the support lever with its inner side, when the support levers are inserted in the space.

A fixing protrusion is formed at the female connector, a locking lever is formed at the connector position assurance, and a locking protrusion that is locked to the fixing protrusion with the connector position assurance moved forward is formed at the locking lever.

A first shield shell made of a conductive metal plate is combined with the female connector, and elastic contact portions, which are bent and brought elastically contact with a conductive ring fitted on a shield part of a shield wire by pressing the conductive ring in contact with it, are formed at the first shield shell.

A plurality of shield wires are combined with the female connector, and the first shield shell has a plurality of elastic contact portions having a rectangular box shape and is in contact with the conductive rings of the shield wires, respectively.

A second shield shell made of a conductive metal plate is combined with the male connector, and the second shield shell has first elastic contact portions that are elastically in contact with the first shield shell by pressing the first shield shell in contact with it, when combined with the first shield shell.

The second shield shell has a second elastic contact portion that is bent and elastically in contact with grounding terminal by pressing the grounding terminal of an electric device combined with the male connector in contact with it.

The second shield shell has elastic supporting portions that are bent and elastically in contact with the inner side of the male connector.

Therefore, according to the shield connector of the present invention, it is possible to improve operability of a connector position assurance when the connector is combined, and ensure contact point stability and reliability between shield conductive parts, simplify shield parts, and improve convenience in assembly.

Other aspects and preferred embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

The above and other features of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1A:
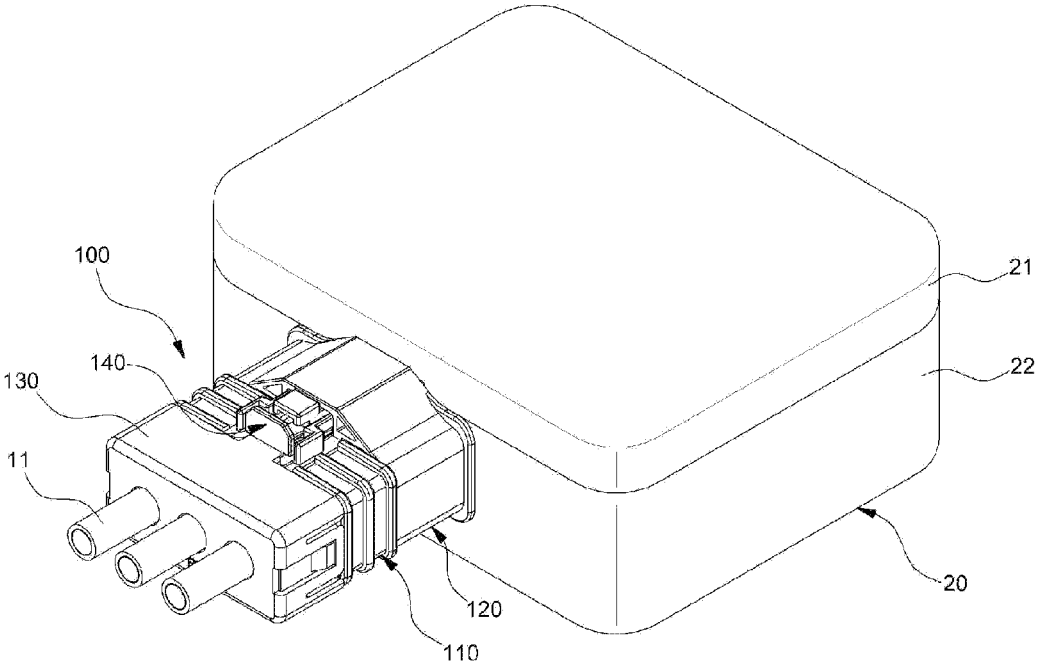
FIGS. 1*a* and 1*b* are perspective views showing a shield connector according to an embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Examples

The following examples illustrate the invention and are not intended to limit the same.

Hereinafter, preferred embodiments of the present invention will be described in detail with reference to the accompanying drawings for those skilled in the art to easily implement the present invention.

Figure 1B:
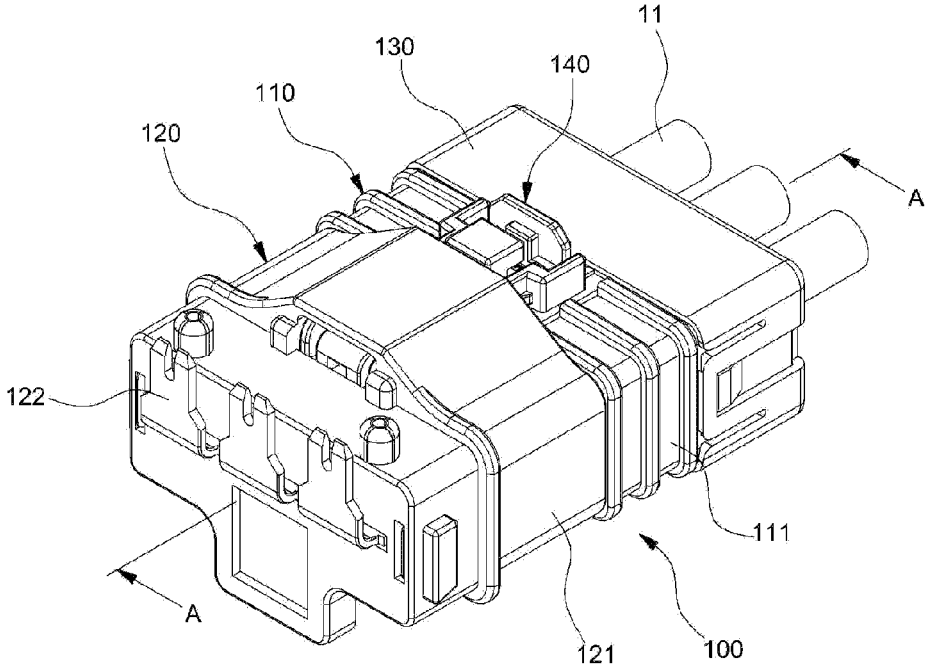
Figure 2:
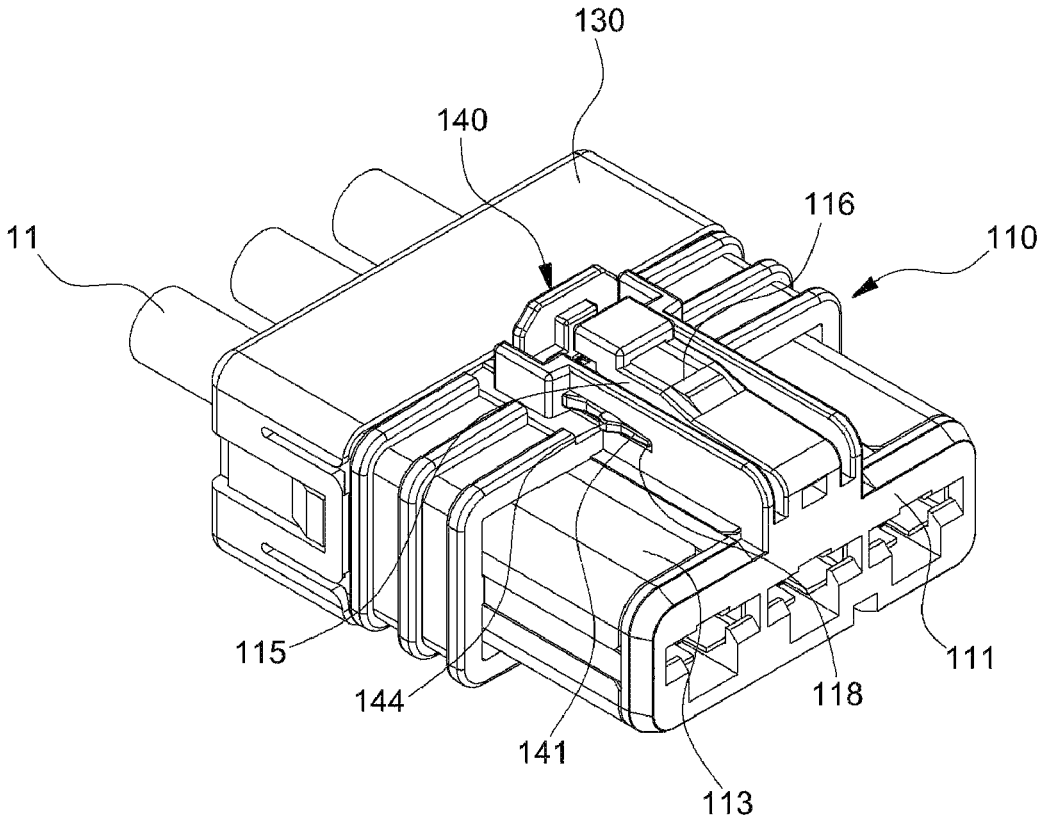
FIGS. 2 and 3 are perspective views showing a female connector and a male connector, respectively, of the shield connector of FIG. 1.
Figure 3:
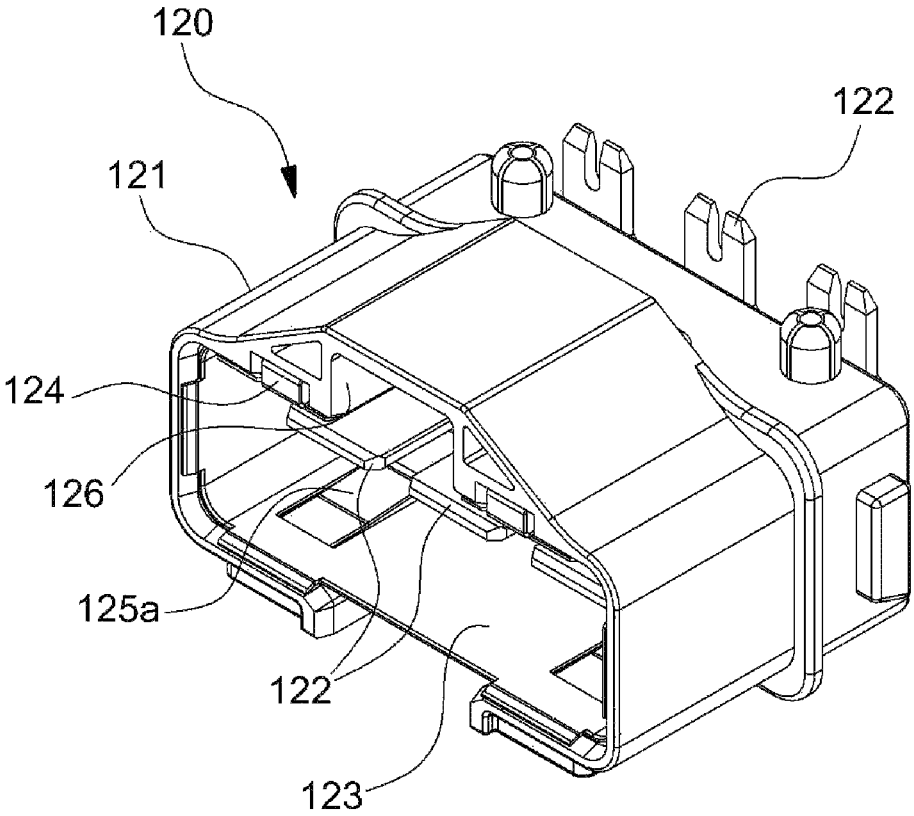
Figure 4:
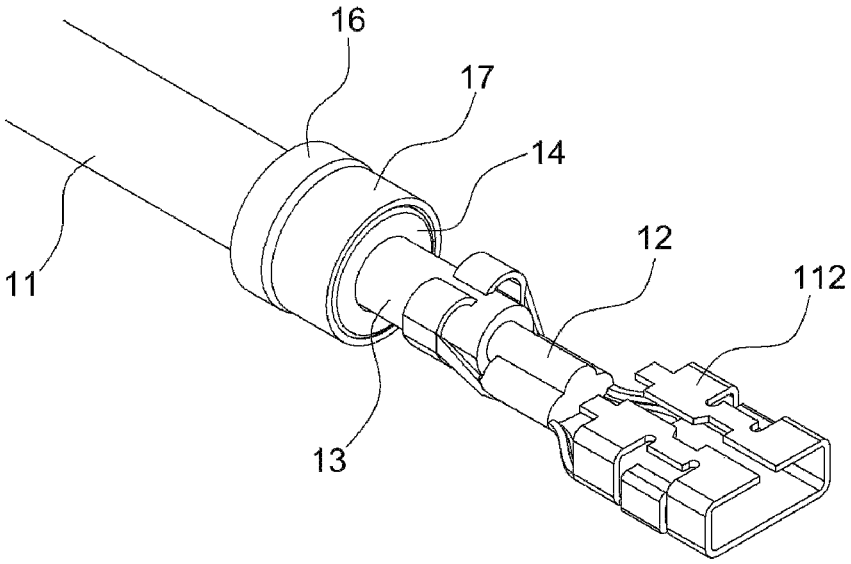
FIG. 4 is a perspective view showing a wire assembly that is combined with the female connector of the shield connector of FIG. 1.

FIGS. 1*a* and 1*b* are perspective view showing a shield connector 100 according to an embodiment of the present invention, FIGS. 2 and 3 are perspective views showing a female connector 110 and a male connector 120, respectively, and FIG. 4 is a perspective view showing a wire assembly 10 that is combined with the female connector 110.

FIG. 1*a* shows the shield connector 100 combined with an electric device 20 according to an embodiment of the present invention.

The shield connector 100 of the exemplary embodiment is a connector that can be applied to an MDPS (Motor Driven Power Steering), but it is only an example, and the scope of the present invention is not limited to the MDPS.

The shield connector 100, which can be used for connecting an electric device 20 such as an MDPS ECU (Electronic Control Unit), has a shield and ground path (e.g., indicated by a dotted line in FIG. 6) from a shield wire 11 to a frame 24, which is a grounding terminal of the electric device 20, through conductive parts in the connector 100.

First, as shown in FIGS. 1*a* and 1*b*, the shield connector 100 includes a female connector 110 and a male connector 120, and a wire assembly 10 is combined with the female connector 110.

The wire assembly 10 has a configuration obtained by fitting a conductive ring 16 and a compressive ring 17 on an end portion of a shield wire 11, and the end portion of the shield wire 11, the conductive ring 16, the compressive ring 17, and a female terminal 112 are disposed in a housing 111 of the female connector 110.

When the female and male connectors 110 and 120 are combined, male terminals 122 of the male connector 120 are inserted to be connected in the female terminal 112.

The shield wire 11 includes a conductive part 12, an inner cover 13 that covers the conductive part 12, a shield part 14 surrounding the inner cover 13, and an outer cover 15 that covers the shield part 14. For example, FIG. 5 is a vertical cross-sectional view of the shield wire 11.

Figure 5:
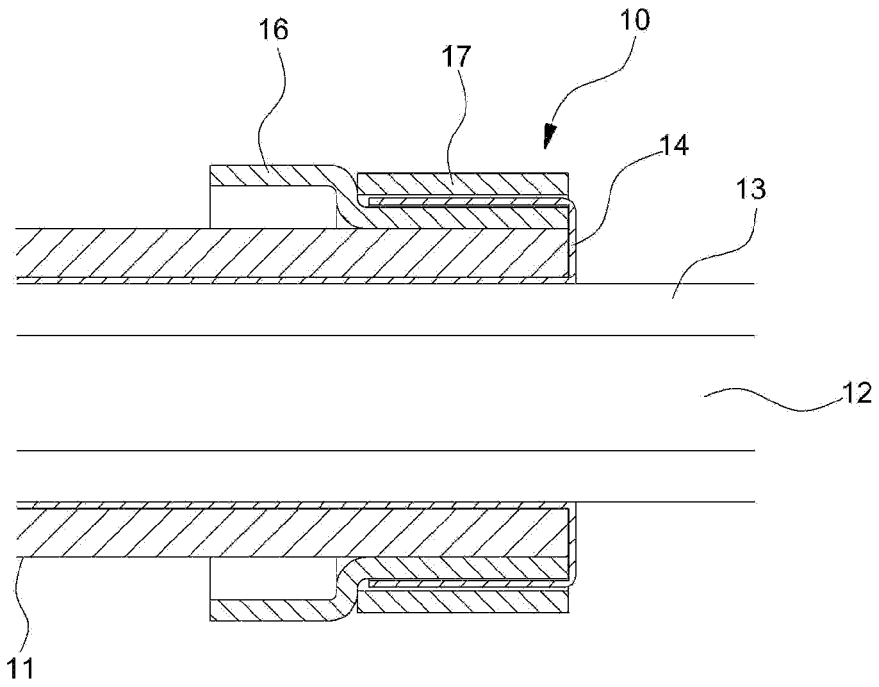
FIG. 5 is a vertical cross-sectional view showing an end portion of a shield wire according to the present invention.

As shown in FIG. 5, a portion of the outer cover 15 is removed so that the shield part 14 is exposed at the end portion of the shield wire 11, and then the conductive ring 16 is fitted on the outer cover 15 of the shield wire 11 and the exposed shield 14 is turned inside out and then put on a side of the conductive ring 16.

The compressive ring 17 is put on and fixed to the outer side of the shield part 14, so the conductive ring 16 and the shield part 14 are fixed under pressure with the shield part 14 between the conductive ring 16 and the compressive ring 17 by the compressive ring 17.

In FIG. 1*a*, the reference numeral '21' indicates a top cover 21 of the electric device 20 and the reference numeral '22' indicates a bottom cover, in which a PCB ('23' in FIG. 7) is disposed inside the top cover 21 and the bottom cover 22 and the male terminals 122 are connected to the PCB 23.

In the housing 121 of the male connector 120, the male terminals 122 are inserted to be connected in the female terminal 112 of the female connector 110 when the female and male connectors 110 and 120 are combined, and the conductive part 12 of the shield wire 11 and the PCB 23 are electrically connected by the combination of the female terminal 112 and the male terminals 122.

The reference numeral '130' indicates a rear holder supporting a plurality of shield wires. The rear holder 130 is coupled to the rear part of the female connector 110 and keeps the shield wire 11 in the housing 111 of the female connector 110 by supporting the shield wire 11.

The conductive ring 16, which is a part forming a shield and ground path by being connected to the shield part 14 of the wire 11, is electrically connected to elastic contact portions 114 of a first shield shell 113 that is disposed in the female connector 110, as described below.

Further, the first shield shell 113 is electrically connected to a second shield shell 123 of the male connector 120, and the second shield shell 123 is electrically connected to the grounding terminal, that is, the grounding frame 24 of the electric device 20 through the elastic contact portions 114.

Accordingly, a shield and ground path is defined sequentially by the shield part 14 of the shield wire 11, the conductive ring 16, the first shield shell 113, the second shield shell 123, and the grounding frame 24 (see the dotted line in FIG. 6), in which the grounding frame 24 is formed at the cover, for example, the bottom cover 22 of the electric device 20 and grounded by being connected with a car body.

Figure 6:
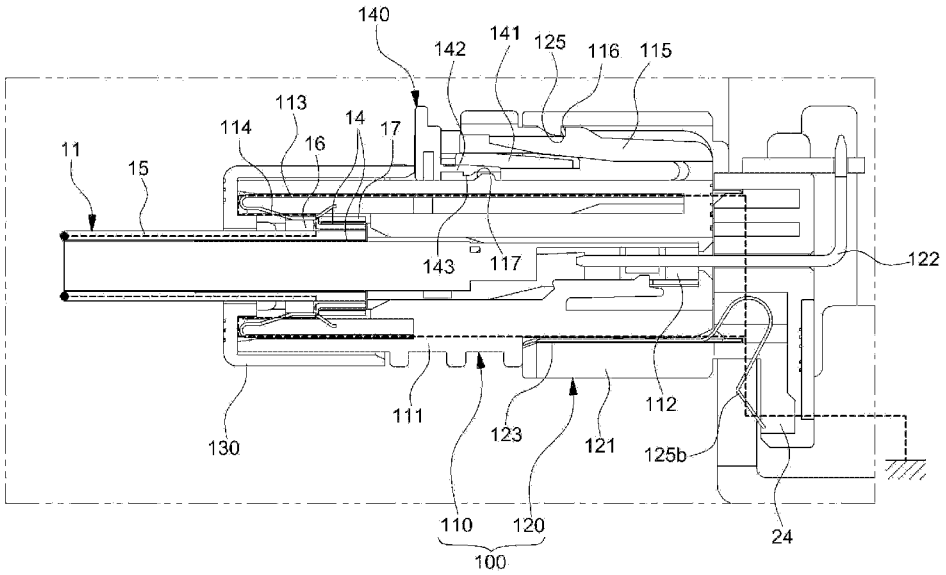
FIGS. 6 and 7 are cross-sectional views of the shield connector according to an embodiment of the present invention.
Figure 7:
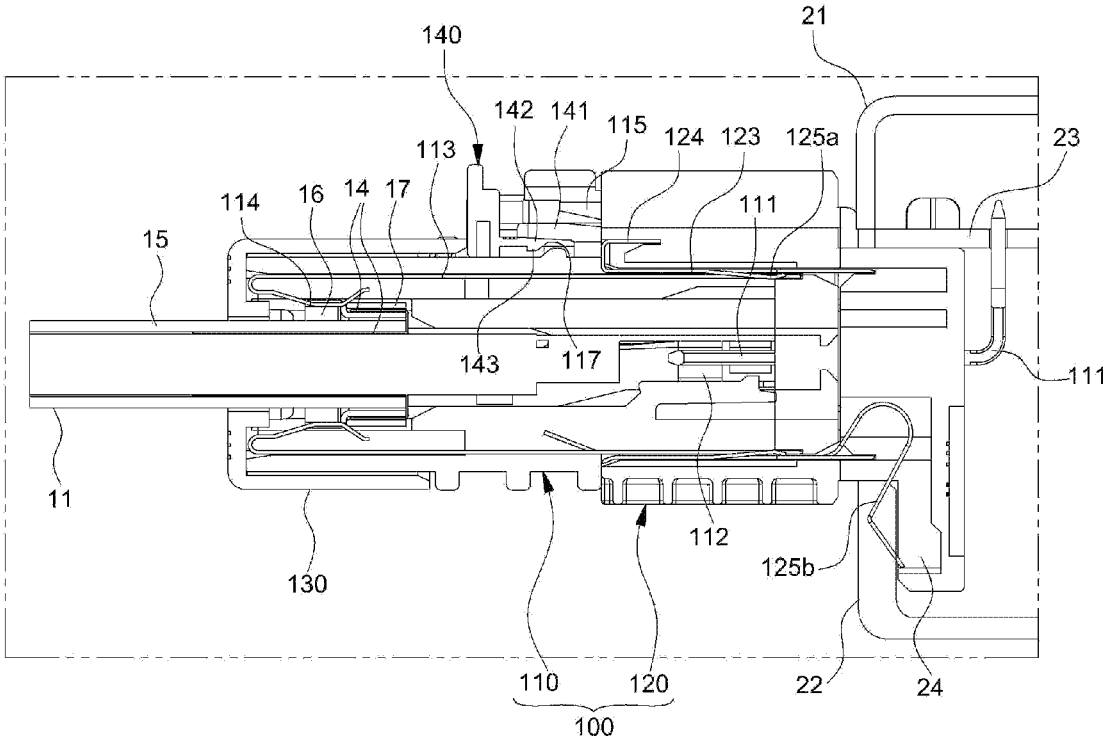

FIG. 6 is a cross-sectional view taken along line 'A-A' in FIG. 1*b* and FIG. 7 is a cross-sectional view taken from another side. In FIG. 6, the shield and ground path defined by the shield part 14 of the wire, the conductive ring 16, the first shield shell 113, and the second shield shell 123 are indicated by a dotted line.

The shield and ground path from the shield part 14 of the wire to the grounding frame 24 can be formed by the shield structure of the shield wire 11 and the connector 100, and accordingly, it is possible to effectively prevent signal noise from being transmitted into the electric device 20 such as an MDPS ECU.

In particular, an elastic spring structure is applied to the contact point between the shield part 14 of the wire and the first shield shell 113, the contact point between the first shield shell 113 and the second shield shell 123, and the contact point between the second shield shell 123 and the grounding frame 24, so that durability can be increased and electric properties can be improved.

Figure 8:
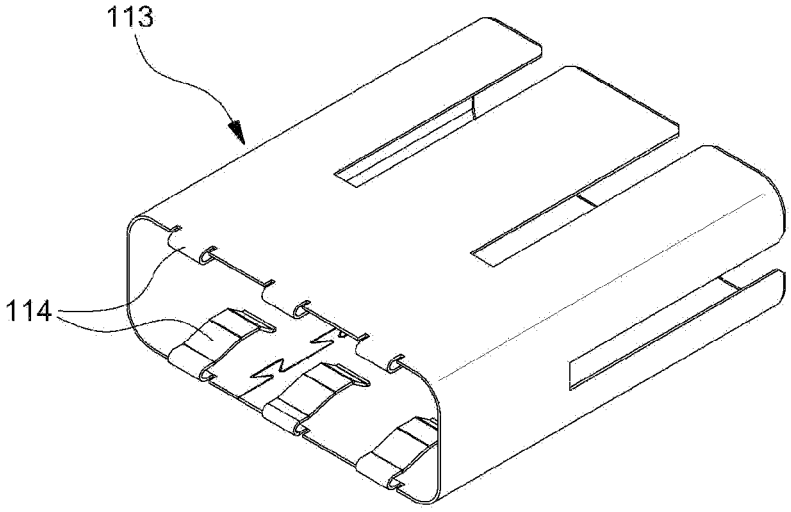
FIG. 8 is a perspective view showing a first shield shell that is fitted in the female connector of the shield connector according to an embodiment of the present invention.

FIG. 8 is a perspective view showing the rectangular box-shaped first shield shell 113 that is combined with the housing 111 of the female connector 110. As shown in FIG. 8, the first shield shell 113 is manufactured by machining a conductive metal plate, similar to the second shield shell 123 to be described below, and the elastic contact portions 114 bending inward are formed at one end of the first shield shell 113.

The elastic contact portions 114, which are parts connected to the outer sides of the conductive rings 16 of wire assemblies, respectively, in the housing 111 of the female connector 110, have an inward bending shape, so they elastically press the outer sides of the conductive rings 16 in contact with them.

Since a plurality of shield wires 11 (a plurality of wire assemblies) are coupled to the female connector 110, a plurality of elastic contact portions 114 bends inside the first shield shell 113 so that they can be elastically connected with the conductive rings 16 of the shield wires 11, respectively.

Further, it is preferable that the elastic contact portions 114 are formed at both the top and the bottom facing each other of the first shield shell 113 so that they can be connected with the shield wires 11 at both sides of the conductive rings 16, respectively, in which two elastic contact portions 114 at the top and the bottom press one conductive ring 16 in contact with it.

As described above, since the elastic contact portion 114 elastically presses the conductive ring 16 in contact with it, the contact pressure between the first shield shell 113 and the conductive ring 16 connected to the shield part 14 can be increased and contact point stability and reliability can be ensured by the increase of the contact pressure between the contact points.

Further, by the spring structure, the movement range when the wire assembly 10 is assembled can be increased, and accordingly, the insertion force for assembling can be reduced and the wire assembly 10 can be more conveniently assembled.

Further, by the integral structure of the first shield shell 113 and the elastic contact portions 114, manufacturing (manufacturing with a press) is easy and fewer parts are used, as compared with using separate elastic members, so price competitiveness can be ensured.

Figure 9:
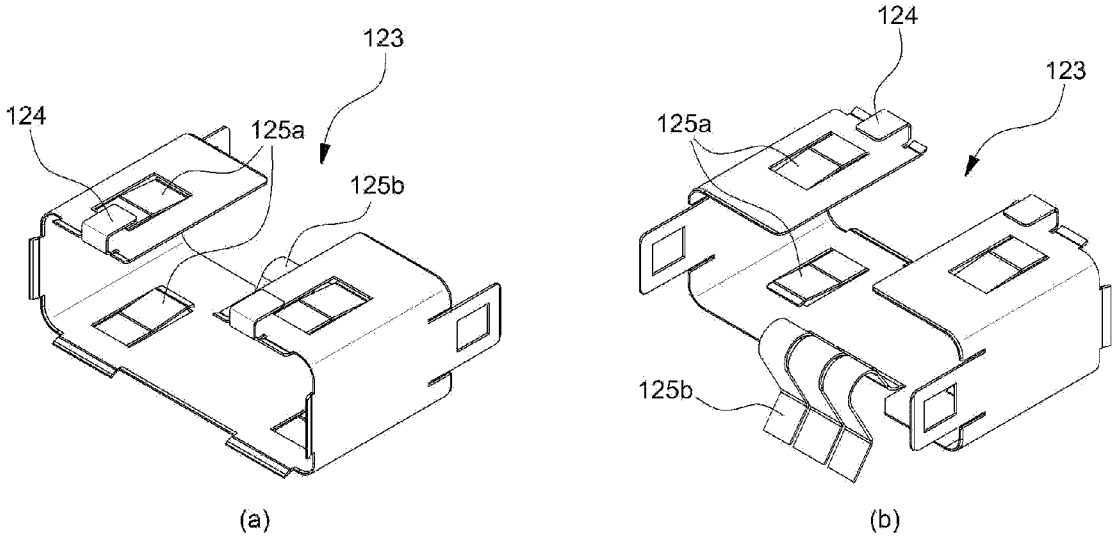
FIG. 9 is a perspective view showing a second shield shell that is fitted on the male connector of the shield connector according to an embodiment of the present invention.

FIG. 9 is a perspective view showing the second shield shell 123 that is combined with the male connector 120. As shown in FIG. 9, the second shield shell 123 is also manufactured by machining a conductive metal plate and disposed outside the first shield shell 113 when it is combined with the female connector 110.

In particular, the first shield shell 113 is inserted in the second shield shell 123 such that the shield shells partially overlap each other at the inside and the outside. Accordingly, a portion of the second shield shell 123 overlaps and surrounds a portion of the first shield shell 113, when the connector 100 is assembled.

In a preferred embodiment, elastic supporting portions 124 that are elastically in contact with the inner side of the housing 121 of the male connector 120 are formed at a side of the upper portion of the second shield shell 123, bending at one end of the second shield shell 123.

The elastic supporting portions 124 are shaped to be able to elastically press the inner side of the housing 121 of the male connector 120 in contact with it and they bend in a U-shape outward from the second shield shell 123 for elastic press and contact.

As described above, when the elastic supporting portions 124 are in contact with the inner side of the male connector 120, they fix and support the second shield shell 123 in the male connector 120, as shown in FIG. 7, and a plurality of elastic supporting portions 124 may be formed, as shown in FIG. 9.

Further, first elastic contact portions 125*a* that elastically press the outer side of the first shield shell 113 in contact with it are formed on the inner side of the second shield shell 123 and a second elastic contact portion 125*b* is the part that forms elastic contact point with the first shield shell 113.

In a preferred embodiment, the first elastic contact portions 125*a* are formed on both of the top and the bottom of the second shield shell 123 and both the first elastic contact portions 125*a* on the top and the bottom form the contact points by simultaneously pressing the outer side of the first shield shell 113.

The first elastic contact portions 125*a* may be formed in a shape with three cutoff sides by punching the top and the bottom of the second shield shell 123 in a U-shape and they are separated from the second shield shell 123 at the three cutoff sides. Accordingly, the first elastic contact portions 125*a* can be elastically moved up/down with respect to the other one connected portion.

As described above, since the two shield shells 113 and 123 are connected in a way that the first elastic contact portions 125*a* of the second shield shell 123 elastically press the outer side of the first shield shell 113 in contact with it, the contact pressure at the contact points can be increased and contact point stability and reliability can be ensured by the spring structures.

Further, since it is possible to finish assembling only by simply assembling and connecting two conductive parts without bolting to connect conductive parts in the related art, convenience of assembly can be improved. Further, since an integral structure of shield shells by contact portions is applied, manufacturing can be easy and price competitiveness can be ensured.

Furthermore, the second elastic contact portion 125*b* is formed at a side on the bottom of the second shield shell 123 in the shape of a bending leaf spring and is the part that is elastically in contact with the grounding frame 24 on the bottom cover 22 of the elastic device in the male connector 120.

The second elastic contact portion 125*b*, which is the part that forms the contact point between the second shield shell 123 (male connector) and the grounding frame 24 of the electric device 20, also elastically presses the grounding frame 24, which is provided as the grounding terminal of the electric device 20, to be connected. Accordingly, it contributes to increasing the contact pressure and ensuring stability and reliability of the contact point.

Referring to FIG. 6, the female connector 110 has a locking lever 115 and a coupling protrusion 125 that locks the female and male connectors 110 and 120 by locking a locking protrusion 116 of the locking lever 115 is formed at the male connector 120.

Accordingly, when the male connector 120 is combined with the female connector 110, the locking protrusion 116 of the locking lever 115 is locked to the coupling protrusion 125 above it, and then when the connector position assurance 140 is pushed inside, that is, the connector position assurance 140 is pressed forward, the support levers 141 of the connector position assurance 140 are moved under the locking lever 115 and support the locking lever 115 from under it.

As described above, when the support levers 141 of the connector position assurance 140 move under the locking lever 115 of the female connector 110, they support the locking lever 115 from under it so that the locking protrusion 116 is locked to the coupling protrusion 125 of the male connector 120 and not pulled out (unlocked), so the female connector 110 and the male connector 120 can be firmly locked.

Further, the connector position assurance 140 has a locking lever 142, which locks the female connector 110 when the support levers 141 support the locking lever 115 of the female connector 110 from under it after the connector position assurance 140 is moved forward. Further, a locking protrusion 143 is formed at the locking lever 142 and a fixing protrusion 117 where the locking protrusion 143 of the locking lever 142 can be locked to prevent rearward movement of the connector position assurance 140 at the lock position is formed at the female connector 110.

Accordingly, the connector position assurance 140 is pushed forward after the female and male connectors 110 and 120 are combined, the support levers 141 of the connector position assurance 140 at the lock position come in contact with the locking lever 115 of the female connector 110 and support the locking lever 115 of the female connector 110, in which the locking protrusion 143 on the locking lever 142 of the connector position assurance 140 is locked to the fixing protrusion 117 of the female connector 110, so the connector position assurance (CPA) 140 is locked and cannot be moved backward.

On the other hand, FIGS. 10 to 13 are views for illustrating the configuration and operation of the connector position assurance 140 in the shield connector 100 according to an embodiment, in which the connector position assurance 140 is combined with the female connector 110 and can slide forward/backward on the female connector 110.

Locking steps 118 where the ends of the support levers 141 are locked to prevent the connector position assurance 140 from moving forward before the male connector 120 is combined are formed at the female connector 110.

The locking steps 118, parts that function as stoppers restricting forward movement of the connector position assurance 140 before the male connector 120 is combined, are formed at positions on the female connector 110 which correspond to the ends of the support levers 141 of the connector position assurance 140

Further, pressing protrusions 144 are formed at a side of the support levers 141 and an insertion portion 126 that is a part in which the locking lever 115 of the female connector 110 is inserted and of which the inner side presses the pressing protrusions 144 of the support lever 141 so that the support levers 141 bend toward the center is formed at the male connector 120.

The insertion portion 126 is formed at the top of the male connector 120 to have an internal space where the locking lever 115 of the female connector 110 is received, and thus, when the female connector 110 is combined with the male connector 120, the locking lever 115 of the female connector 110 is inserted in the insertion portion 126.

Further, the locking protrusion 143 to which the locking protrusion 116 of the locking lever 115 is formed on the inner side of the insertion portion 126.

Accordingly, when the female connector 110 is combined with the male connector 120, the support levers 141 formed in parallel at both left and right sides of the connector position assurance 140 are also inserted into the insertion portion 126 and the inner side of the insertion portion 126 presses the pressing protrusions 144 of the support levers 141.

Accordingly, as the two support levers 141 at both left and right sides of the connector position assurance 140 bend toward the center, the ends of the support levers 141 are separated and unlocked from the locking steps 118 of the female connector 110 and locking by the locking steps 118 that function as stoppers is removed, so the connector position assurance 140 can move forward.

Accordingly, when the locking by the locking steps 118 when the female and male connectors 110 and 120 is removed, that is, when the restriction on the forward movement of the connector position assurance 140 by the locking steps 118 is removed, as the connector position assurance 140 is pushed forward, the connector position assurance 140 is moved forward while the two support levers 141 at both sides close to the center portion.

As a result, when the connector position assurance 140 moves forward to the lock position, the support levers 141 come in contact with the locking lever 115 of the female connector 110 and support the locking lever 115 from under it, and in which the locking protrusion 143 of the locking lever 142 is locked to the fixing protrusion 117 of the female connector 110, so that connector position assurance 140 is locked.

Figure 10:
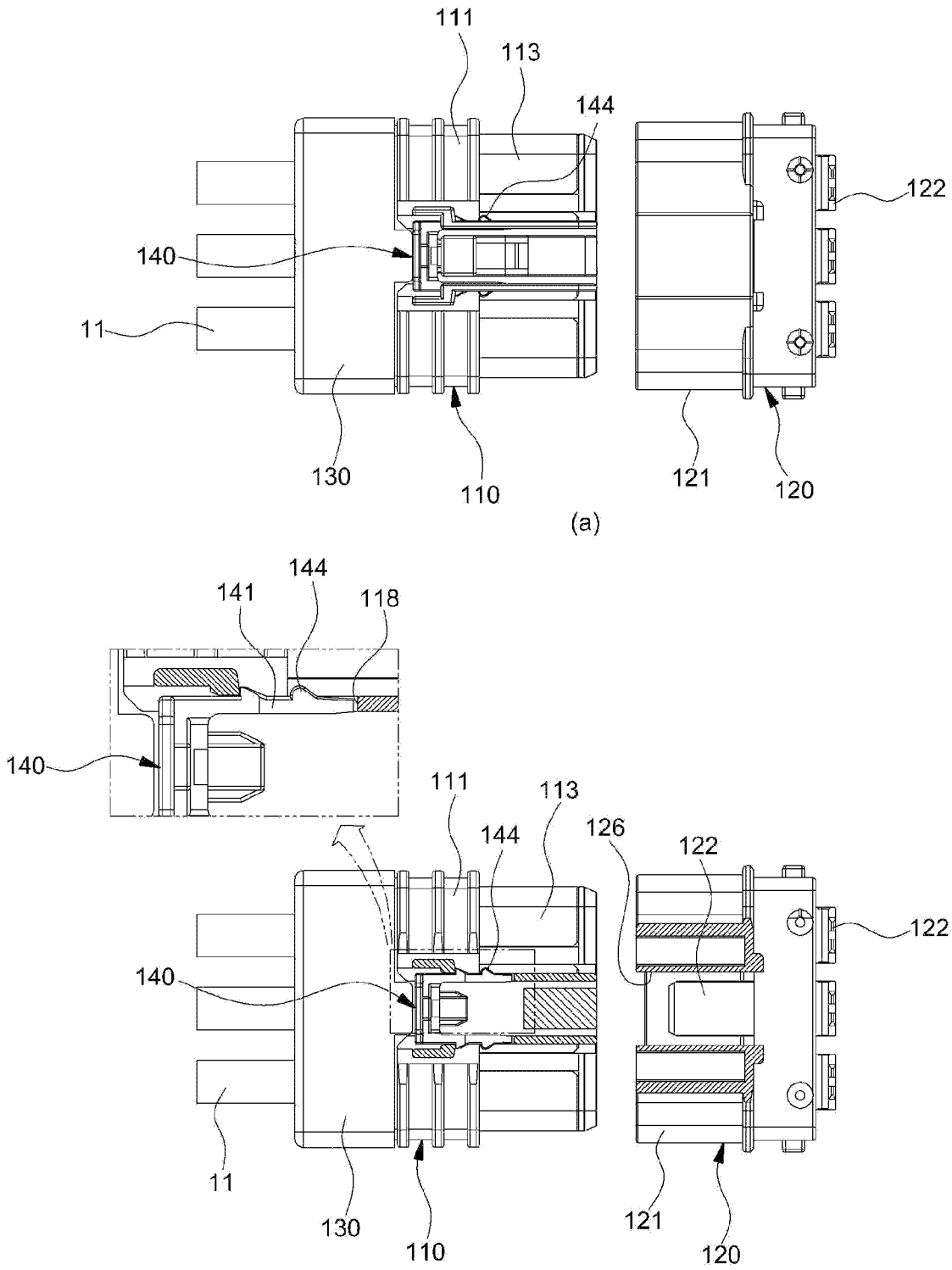
FIGS. 10-13 are views showing a process of combining the female and male connectors and a process of locking a connector position assurance in the present invention.
Figure 11:
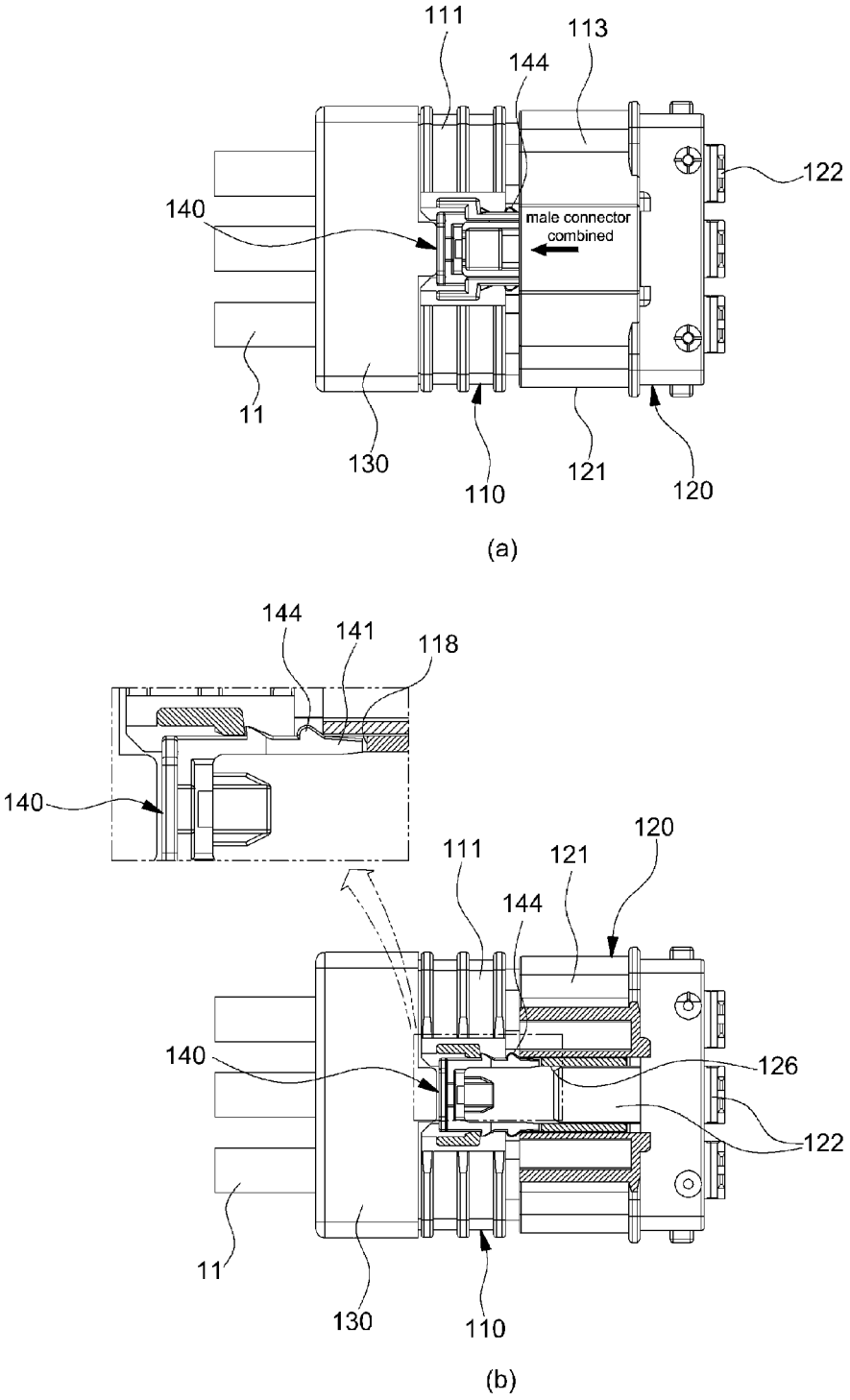
Figure 12:
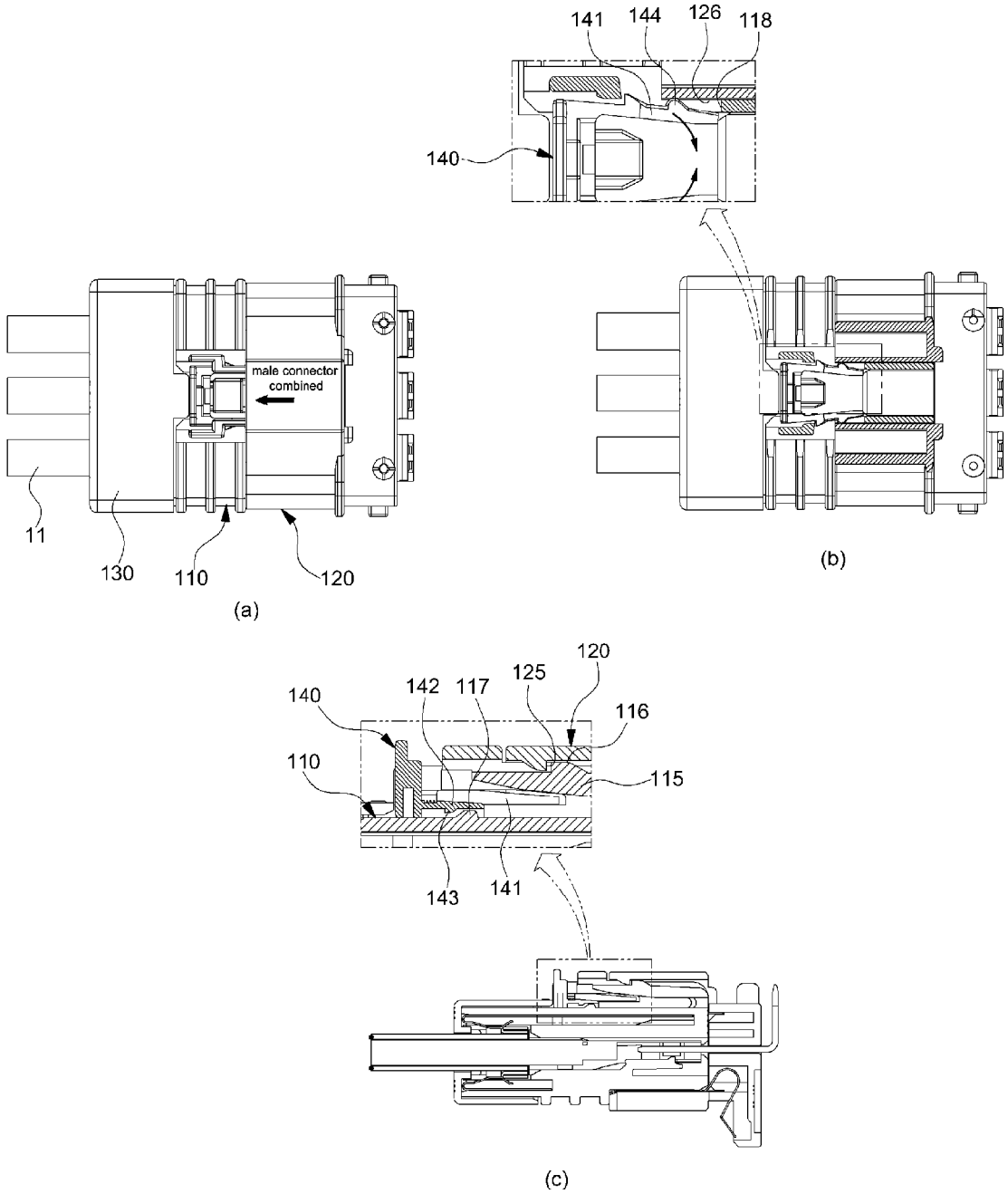
Figure 13:
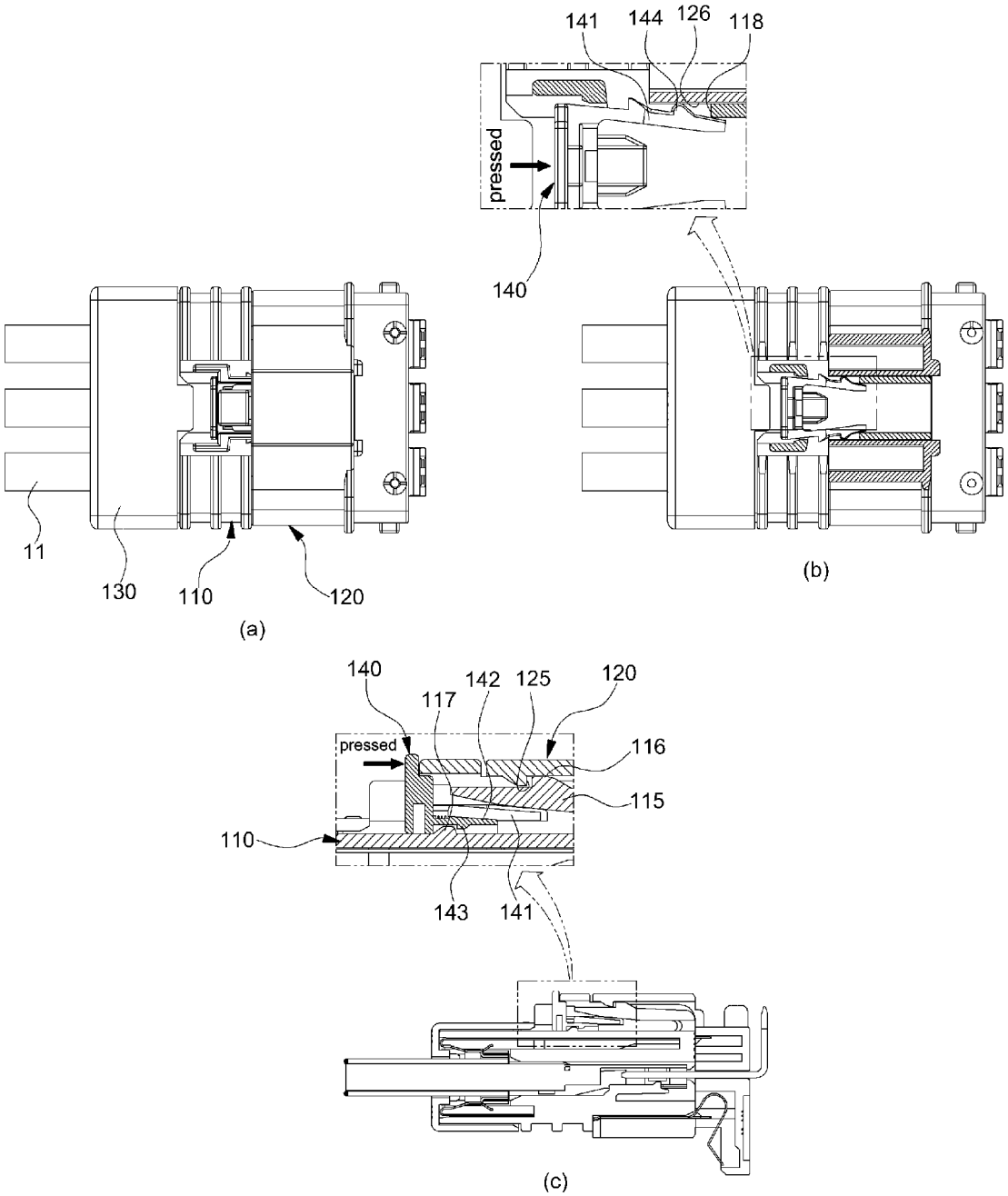

FIGS. 10 to 13 show a process of combining the female and male connectors 110 and 120 and a process of locking the connector position assurance 140, in which the female and male connectors 110 and 120 are not combined yet in FIG. 10, stopper locking of the connector position assurance 140 is removed in FIG. 11, the connector position assurance 140 is not operated yet with the female and male connectors 110 and 120 combined in FIG. 12, and the connector position assurance 140 is operated and locked in FIG. 13.

First, in FIG. 10, when the female and male connectors 110 and 120 are not combined yet, the ends of the support levers 141 of the connector position assurance 140 are locked to the locking steps 118 of the female connector 110, that is, blocked by the locking steps 118.

The connector position assurance 140 is fixed and cannot be pushed inside by the locking steps 118 that function as stoppers, that is, the connector position assurance 140 cannot be moved forward, which is the stopper locking.

Next, as the female connector 110 is combined with the male connector 120, the inner side of the insertion portion 126 of the male connector 120 presses the pressing protrusions 144 of both support levers 141 inward from the outside, that is, toward the center.

Accordingly, while both of the left and right support levers 141 close to the center portion (inside), the ends of the support levers 141 are separated from the locking steps 118 toward the center portion, so the stopper locking is removed and the connector position assurance 140 can be moved forward accordingly (see FIG. 11).

Next, when the female connector 110 is fully fitted and combined with the male connector 120, the female connector 110 and the male connector 120 are locked, in which the locking protrusion 116 of the locking lever 115 is locked to the coupling protrusion 125 of the male connector 120 and the female connector 110 is locked without being pulled out from the male connector 120 (see FIG. 12).

Next, when a user presses and pushes the connector position assurance 140 inside (the connector position assurance is moved forward), the connector position assurance 140 is locked, in which, as shown in FIG. 13, the support levers 141 of the connector position assurance 140 support the locking lever 115 of the female connector 110 from under it so that the locking by the locking lever 115 is not removed and the locking protrusion 143 of the locking lever 142 is engaged with the fixing protrusion 117 of the female connector 110, so the connector position assurance 140 is fixed and cannot be pulled back.

When the connector position assurance 140 is locked, the female connector 110 and the male connector 120 are completely combined.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A shield connector, comprising:

a female connector having a female terminal connected to a shield wire and a locking protrusion for locking to a male connector;

the male connector having a male terminal connected to the female terminal when the male connector is combined with the female connector, and a coupling protrusion to which the locking protrusion is locked for locking with the female connector; and a connector position assurance that is combined with the female connector to be movable forward/backward and has support levers that support the locking protrusion and prevent the locking protrusion from being unlocked from the coupling protrusion when the connector position assurance is moved forward, wherein locking steps, to which the support levers are locked so that the connector position assurance cannot be moved before the female connector and the male connector are combined, are formed at the female connector, and an insertion portion, which unlocks the support levers from the locking steps by pressing respective pressing protrusions on the support levers when the female connector and the male connector are combined, is formed at the male connector;

wherein a second shield shell made of a conductive metal plate is combined with the male connector, and the second shield shell has first elastic contact portions that are elastically in contact with the first shield shell by pressing the first shield shell, when combined with the first shield shell, wherein the second shield shell has a second elastic contact portion that is bent and elastically in contact with a grounding terminal by pressing a grounding terminal of an electric device combined with the male connector.

2. The shield connector of claim 1, wherein the insertion portion has a space, where the locking lever of the female connector and the support levers of the connector position assurance are inserted, when the male connector and the female connector are combined, and presses the pressing protrusions of the support lever with its inner side, when the support levers are inserted in the space.

3. The shield connector of claim 1, wherein a fixing protrusion is formed at the female connector, a locking lever is formed at the connector position assurance, and a locking protrusion that is locked to the fixing protrusion with the connector position assurance moved forward is formed at the locking lever.

4. The shield connector of claim 1, wherein a first shield shell made of a conductive metal plate is combined with the female connector, and elastic contact portions, which are bent and elastically in contact with a conductive ring fitted on a shield part of a shield wire by pressing the conductive ring, are formed at the first shield shell.

5. The shield connector of claim 1, wherein a plurality of shield wires are combined with the female connector, and the first shield shell has a plurality of elastic contact portions that have a rectangular box shape and are in contact with the conductive rings of the shield wires, respectively.

6. The shield connector of claim 1 wherein the second shield shell has elastic supporting portions that are bent and elastically in contact with the inner side of the male connector.

* * * * *